US008166974B2

(12) United States Patent
Pedemonte

(10) Patent No.: US 8,166,974 B2
(45) Date of Patent: May 1, 2012

(54) SECOND-STAGE REGULATOR FOR SCUBA DIVERS

(75) Inventor: Stefano Pedemonte, Ceranesi (IT)

(73) Assignee: Cressi-Sub S.p.A., Genoa (IT)

( * ) Notice: Subject to any disclaimer, the term of this patent is extended or adjusted under 35 U.S.C. 154(b) by 1435 days.

(21) Appl. No.: 10/899,198

(22) Filed: Jul. 26, 2004

(65) Prior Publication Data

US 2005/0016537 A1 Jan. 27, 2005

(30) Foreign Application Priority Data

Jul. 25, 2003 (IT) ..... FI2003A0199

(51) Int. Cl.
*A61M 16/00* (2006.01)
*A62B 7/04* (2006.01)
*A62B 9/02* (2006.01)
*F16K 31/26* (2006.01)

(52) U.S. Cl. ..... 128/205.26; 128/205.24

(58) Field of Classification Search ..... 128/204.26, 128/201.26–28, 200.29, 205.24, 206.29; 137/907–908, 494; 251/84–88
See application file for complete search history.

(56) References Cited

U.S. PATENT DOCUMENTS 3,336,920 A * 8/1967 Thomas ..... 601/106
3,570,808 A * 3/1971 Wrenn ..... 251/149.6
4,127,129 A * 11/1978 Cramer ..... 128/204.28
4,297,998 A * 11/1981 Christianson ..... 128/204.26
5,233,976 A * 8/1993 Ferguson ..... 128/204.26
5,259,375 A * 11/1993 Schuler ..... 128/205.24
5,265,596 A * 11/1993 Sauze ..... 128/205.24
5,503,140 A * 4/1996 Winefordner et al. ... 128/200.29
5,735,269 A * 4/1998 Preece ..... 128/205.24
5,787,883 A * 8/1998 Cramer ..... 128/205.24
5,803,073 A * 9/1998 Toth ..... 128/205.24
5,950,622 A * 9/1999 Pomerantz ..... 128/204.26
5,970,977 A * 10/1999 Sattelberg ..... 128/205.24
6,209,579 B1 * 4/2001 Bowden et al. ..... 137/557
6,609,519 B2 * 8/2003 Pietrelli ..... 128/204.26
6,718,977 B1 * 4/2004 Matsuoka ..... 128/204.26
6,848,445 B2 * 2/2005 Garofalo ..... 128/204.26

* cited by examiner

*Primary Examiner* — Justine R Yu
*Assistant Examiner* — Kristen C Matter
(74) *Attorney, Agent, or Firm* — Pollack, P.C.

(57) ABSTRACT

A second-stage regulator for scuba divers is disclosed that reduces considerably the inhalation effort required by the user through reduction in friction between selected components of the regulator. A flexible sleeve is sealingly connected to the regulator poppet and the baffle, and coaxially with the poppet, so as to avoid blow-by of gaseous mixture through an opening in the baffle. A tail of the poppet extends through the opening, the tail being connected to a lever of the regulator projecting into an outlet chamber thereof. The head of the poppet is or includes a ferrule with an at least partially-circular profile and abuts a selected inner portion of the inlet's intermediate chamber to allow oscillation of the poppet. The lever end of the regulator contacts a diaphragm, the diaphragm separating the outlet chamber from the external environment. The lever end has a generally arched shape with a profile such that the length of the arch between two adjacent contact points measured along the lever is generally equal to the length of the segment between the same adjacent contact points measured along the diaphragm.

14 Claims, 6 Drawing Sheets

Prior Art

SECOND-STAGE REGULATOR FOR SCUBA DIVERS

FIELD OF THE INVENTION

The present invention relates generally to equipment for use in limited oxygen environments and, more particularly, to control devices for underwater activities or the like.

BACKGROUND OF THE INVENTION

In scuba diving, for instance, a supply of air, or of an air-oxygen mixture, is typically fed to a mouthpiece of the scuba diver from a high-pressure tank. Enroute to the diver, the air passes from a primary or first-stage pressure-reducing regulator to a second-stage regulator which, in turn, supplies the mixture to the mouthpiece, namely, when pressure within the regulator is diminished upon the diver's inhalation.

Second-stage regulators typically have an inlet chamber connected to an outlet of the first-stage regulator, and an outlet chamber connected to the mouthpiece of the user. The outlet chamber is separated from the external environment by an elastically deformable diaphragm. The diaphragm is joined via a lever to a poppet which closes a passage between the inlet and outlet chambers.

Through appropriate calibration of the first-stage regulator, the pressure inside the inlet chamber is maintained relatively constant at approximately ten bars as the pressure in the tank varies. When the user does not breathe, his or her lungs, the mouthpiece, the outlet chamber and the outside environment are generally at the same pressure. When the user inhales, on the other hand, a vacuum is created in the outlet chamber, and the diaphragm bends toward the interior of the chamber, moving the poppet, which normally closes the passage between the inlet and outlet chambers, to an open or operative position.

Opening the passage between the inlet and outlet chambers causes excess pressure in the outlet chamber, such that the diaphragm returns to a stowed or resting position, in turn, moving the lever and returning the poppet to a starting or stowed position at which the passage between the inlet and outlet chambers is again in a closed position.

In this manner, the vacuum created when the user inhales effectively controls movement of the interconnected mechanical actuating members, i.e., the diaphragm, lever and poppet. The exertion or energy required by the user, upon inhalation, must also account for the energy dissipated by friction between the mechanical members.

OBJECTS AND SUMMARY OF THE INVENTION

Accordingly, it is an object of the present invention to provide an improved second-stage regulator for scuba divers that requires considerably less inhalation effort by the user than conventional second-stage regulators and, thereby, allows the user to breathe with greater ease.

While conventional arrangements for second-stage regulators have been found useful, substantial friction between the interconnected mechanical actuating members, e.g., the diaphragm, lever and poppet, must often be overcome, requiring considerable additional inhalation effort by the user, thus affecting his or her ease of breathing in limited oxygen environments.

Another object of the present invention is to provide a second-stage regulator for scuba divers that significantly reduces friction between mechanical members or components as compared to that of conventional second-stage regulators.

A further object of the present invention is to provide a second-stage regulator for scuba divers where the relative sliding of mutually contacting, mechanical members is virtually eliminated and replaced by rolling friction.

According to one aspect of the present invention, there is provided a second-stage regulator for scuba divers, the regulator including a relatively flexible sleeve, inside an intermediate chamber and coaxial to a poppet, with an airtight connection both to the poppet and a baffle around the opening, thus preventing blow-by of a gaseous mixture through an opening created by a tail of the poppet and an opening in the baffle containing the poppet, and associated dissipation of energy due to formation of tiny ice crystals.

In accordance with another aspect of the present invention, a second-stage regulator for scuba divers is provided in which a head of the poppet is inside a ferrule of substantially rectangular cross-section, the section of which that is in a median longitudinal plane (that also includes the lever) additionally having at least a part with a circular profile abutting an inner wall of the intermediate chamber, enabling the poppet to oscillate in the longitudinal plane. In this manner, an end of the lever that is attached to the tail of the poppet moves integrally with the tail, with negligible sliding, and any friction induced is only of a rolling type as a circular profile of the ferrule turns against the inner wall.

According to a further aspect of the present invention, a second-stage regulator for scuba divers is provided, wherein the end of the lever that is in contact with a rigid plate, associated with the diaphragm, and separating the external environment from the regulator's outlet chambers, has an arched shape following a profile such that the arch extending between two adjacent points of contact measured along the lever is generally equal to the length of the segment between the same adjacent points of contact measured along the rigid plate, such that the resistance generated upon relative movement between the members is substantially of the rolling friction.

In accordance with still another aspect of the present invention, there is provided a second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm. The inlet conduit forms an inlet chamber and an intermediate chamber separated by a valve seat, against which a head of a poppet movable within the intermediate chamber is elastically biased. A tail of the poppet projects into an outlet chamber through an opening in a baffle that separates the intermediate chamber from the outlet chamber, and is connected to one end of a lever hinged to the baffle. The other end of the lever rests against the diaphragm so that a vacuum generated upon the user's inhalation causes the diaphragm inside the outlet chamber to flex inwardly and the lever to rotate, with consequential displacement of the poppet that, when lifted away from the valve seat, allows passage of the gaseous mixture from the inlet chamber, through the intermediate chamber and a passage between the intermediate chamber and the outlet chamber, to the outlet chamber. Inside the intermediate chamber, and coaxial to the poppet, a flexible sleeve is coupled by an airtight connection to the poppet and to the baffle about the opening in the baffle, the width of the poppet tail being substantially less than that of the opening so as to provide clearance for movement of the tail transversely to the opening of the baffle.

According to yet another aspect of the present invention, second-stage regulator for scuba divers is provided. The regulator comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm. The inlet conduit forms an inlet chamber and an intermediate chamber separated by a valve seat, against which a head of a poppet movable within the intermediate chamber is elastically biased. A tail of the poppet projects into an outlet chamber through an opening in a baffle that separates the intermediate chamber from the outlet chamber, and is connected to one end of a lever hinged to the baffle. The other end of the lever rests against the diaphragm so that a vacuum generated upon the user's inhalation causes the diaphragm inside the outlet chamber to flex inwardly and rotation of the lever, with a consequent displacement of the poppet that, when lifted away from the valve seat, allows passage of the gaseous mixture from the inlet chamber, through the intermediate chamber and a passage between the inlet chamber and the outlet chamber, to the outlet chamber. The head of the poppet is inside a ferrule of substantially rectangular cross section, the cross section of the ferrule being in a median longitudinal plane of the second-stage regulator. Such plane also includes the lever, having an at least partially-circular profile abutting an inside wall of the intermediate chamber, enabling the poppet to oscillate in the longitudinal plane.

In accordance with still a further aspect of the present invention, there is provided a second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm. The inlet conduit forms an inlet chamber and an intermediate chamber separated by a valve seat, against which a head of a poppet movable within the intermediate chamber is elastically biased. A tail of the poppet projects into an outlet chamber through an opening in a baffle that separates the intermediate chamber from the outlet chamber, and is connected to one end of a lever hinged to the baffle. The other end of the lever rests against the diaphragm so that a vacuum generated upon the user's inhalation causes an inward flexing of the diaphragm inside the outlet chamber and rotation of the lever, with a consequent displacement of the poppet that, when lifted away from the valve seat, allows passage of the gaseous mixture from the inlet chamber, through the intermediate chamber and a passage between the intermediate chamber and the outlet chamber, to the outlet chamber. The end of the lever in contact with the diaphragm has a generally arched shape with a profile such that the length of the arch between two adjacent points of contact measured along the lever is generally equal to the length of the segment between the same two adjacent points of contact measured along the diaphragm or a rigid plate attached to the diaphragm, wherein the poppet oscillates transversely to the opening of the baffle.

BRIEF DESCRIPTION OF THE DRAWINGS

A specific, illustrative second-stage regulator for scuba divers, in accordance with the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
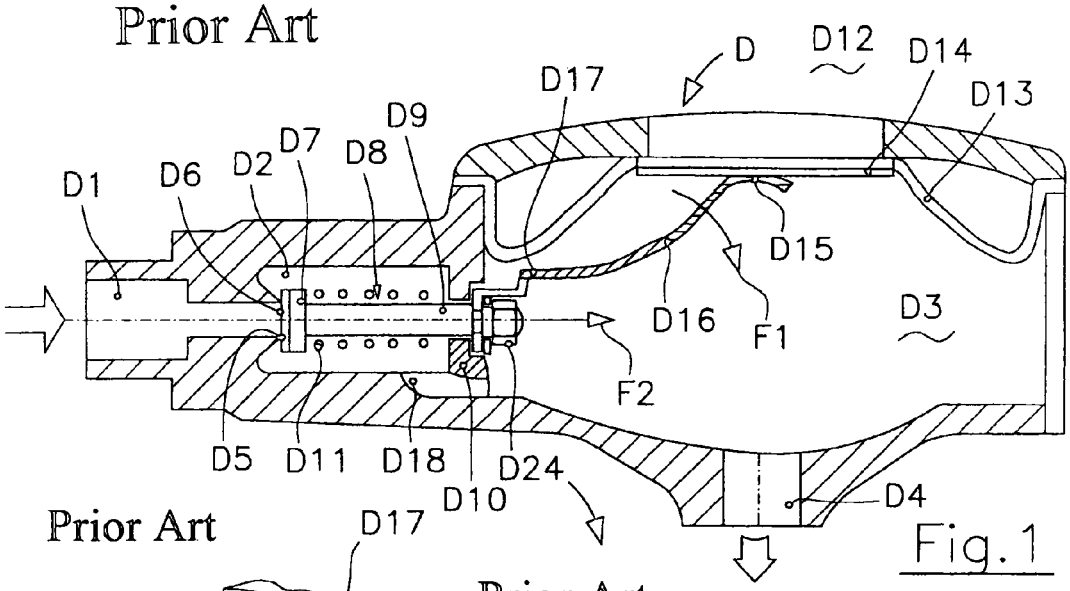
Fig. 1 Prior Art
FIG. 1 is a sectional view of a conventional second-stage regulator.

A conventional second-stage regulator D is shown, for instance, in FIGS. 1-4. The regulator has an inlet chamber D1, an intermediate chamber D2, and an outlet chamber D3 connected to a user's mouthpiece D4. Inlet chamber D1, which is at the same pressure as that of the outlet of an associated first-stage regulator, is separated from the intermediate chamber by a valve seat D5. The valve seat supports a seal D6 on a head D7 of a poppet D8. The poppet has a tail D9 passing loosely through a hole D10*a* in a baffle D10, between the intermediate chamber and outlet chamber. Generally speaking, a purpose of the baffle is to support a spring D11 that compresses the head of poppet D8 against valve seat D5.

The outlet chamber is separated from the external environment by a diaphragm D13. An outer end D15 of a lever D16 abuts a thin rigid plate D14 on an inner surface of the diaphragm. Another, inner end D17 of the lever is hingedly connected to the baffle and supports the tail of the poppet which projects from the baffle and into outlet chamber D3.

Under balanced conditions, the outlet chamber of the second-stage regulator is at the same pressure as that of the user's lungs, which are, in turn, at the same pressure as in the external environment. When the user inhales, a vacuum is created in the outlet chamber relative to the external environment. This causes the diaphragm to flex inwardly, with associated rotation of lever D16 in the direction of arrow F1 (shown by a dotted line in FIG. 2), and displacement of the poppet in the direction of arrow F2. As a result, a breathable gas mixture, under pressure, passes from inlet chamber D1 to outlet chamber D3, through intermediate chamber D2 connected to the outlet chamber by a wide passage D18.

When the mixture from the inlet chamber reaches the outlet chamber, thereby increasing the pressure in the latter, diaphragm D13 returns to its stowed or resting position, as do lever D16 and poppet D8, which once again close seat D5. This, in turn, causes the inlet chamber to separate from the intermediate and outlet chambers until the user inhales again.

Although it is considered desirable that the vacuum created upon the user's inhalation require minimal respiratory effort by the user, with conventional second-stage regulators, the user must exert additional effort, upon inhaling, to account for friction that inevitably accompanies movement of the diaphragm, lever and poppet. Moreover, the vacuum to be produced by the user may not be reduced by simply increasing the dimensions of the diaphragm, as the size of the second-stage regulator is physically limited by the dimensions of those upstream and downstream of the regulator.

Generally speaking, friction in second-stage regulators has several causes. One is blow-by of gas mixture from intermediate chamber D2 to outlet chamber D3, through an annular opening between tail D9 of poppet D5 and hole D10*a* in baffle D10. Although most of the breathable gas mixture passes from the intermediate chamber to the outlet chamber through wide passage D18, a modest quantity inevitably also passes through the annular opening. Since passage of the mixture from the intermediate chamber to the outlet chamber is accompanied by expansion, and consequently cooling, the humidity of the mixture is converted to tiny ice crystals that generate friction during axial movement of the tail of the poppet.

Another cause of friction is rubbing of outer end D15 of lever D16 against the inner surface of plate D14 applied under diaphragm D13, as the latter flexes into the outlet chamber under the vacuum induced by the user's inhalation. Despite the generally curved shape of the lever's outer end, the point of contact between the lever and diaphragm varies as the latter flexes. The result is sliding friction between the two that must be overcome by a portion of the vacuum created by the user. Friction is additionally caused by rubbing of an inner. end D17 of the lever where it comes into contact with the tail of the poppet.

Figure 4:
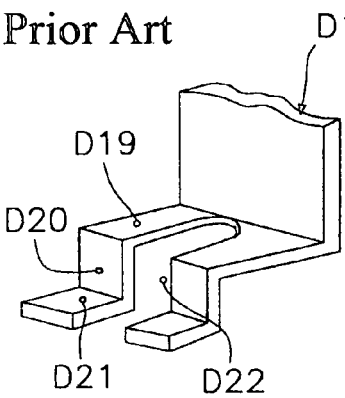
Fig. 4 Prior Art
FIG. 4 is a perspective view of a foot of the regulator actuator lever shown in FIG. 1.
Figure 3:
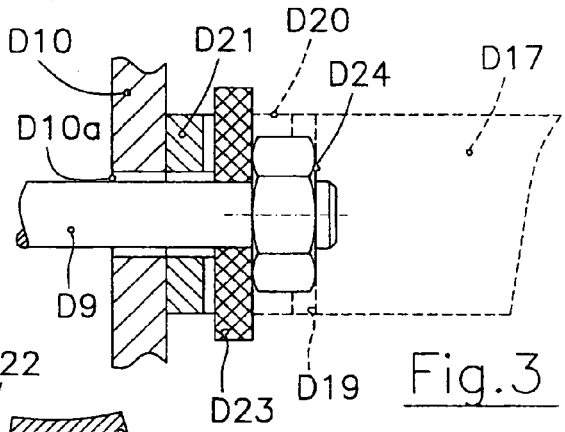
Fig. 3 Prior Art
FIG. 3 is a sectional view taken along line III-III of FIG. 2.
Figure 2:
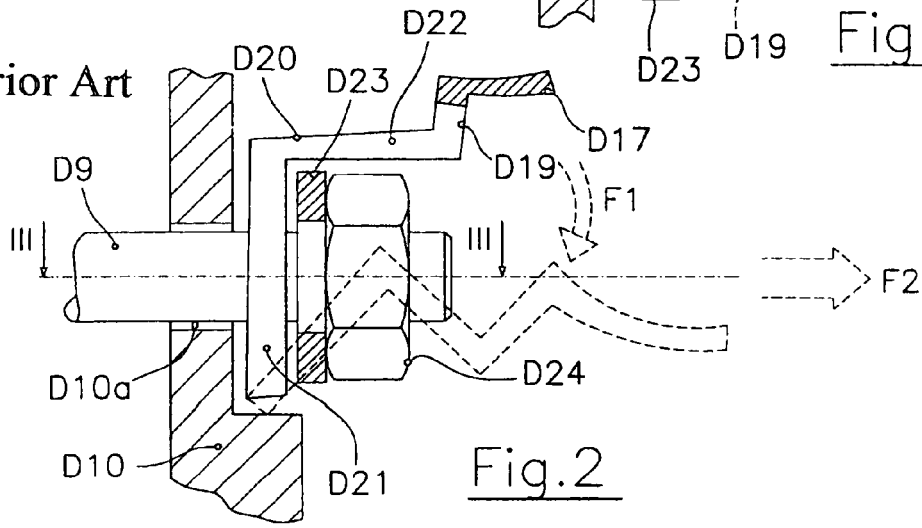
FIG. 2 is an enlarged detail view of an actuating lever end portion of the regulator shown in FIG. 1.

As shown in FIGS. 2, 3 and 4, the inner end of the lever typically comprises a first flange D19, substantially perpendicular to the inner end. At one end of the first flange is a second flange D20, substantially parallel to the inner end of the lever, and a third flange D21 parallel to the first flange and facing the same direction. The profile of inner end D17 is, therefore, shaped by the succession of flanges D19, D20 and D21, substantially in the form of a Z. Finally, the presence of a longitudinal slot D22 defines two branches of a resulting Z-shaped fork that fits around the tail of the poppet between a washer D23 and the side of the baffle facing the outlet chamber, the washer being supported by a nut D24 screwed onto a threaded end of the tail.

The baffle operates as a fulcrum for third flange D21 of inner end D17 and, as it turns, displaces washer D23, together with poppet D8, in the direction of arrow F2, overcoming a biasing force of spring D11. As the lever turns, the two branches of the third flange eventually slide against the washer and the baffle. The resulting friction must then be overcome by a portion of the vacuum generated by the user when he or she inhales.

Referring now to FIGS. 5-14, there is shown generally a specific, illustrative second-stage regulator for scuba divers, in accordance with various aspects of the present invention. According to one embodiment, illustrated generally in FIGS. 5 and 6, a regulator body 30 is provided, the body having an inlet conduit 31 and an outlet conduit 32. The inlet conduit connects to a first-stage regulator that delivers a breathable gaseous mixture at a relatively constant pressure. Its interior forms an inlet chamber 1 and an intermediate chamber 2, separated by a valve seat 5 supporting a seal 6 of a head 7 of a poppet 8. The poppet has a tail 9 that passes relatively loosely through a hole 10*a* in a baffle 10. The baffle separates intermediate chamber 2 from an outlet chamber 3 communicating, through outlet conduit 32, with a mouthpiece applied thereto (not shown). Baffle 10 provides support for a spring 11 that compresses the head of the poppet against the valve seat.

Figure 5:
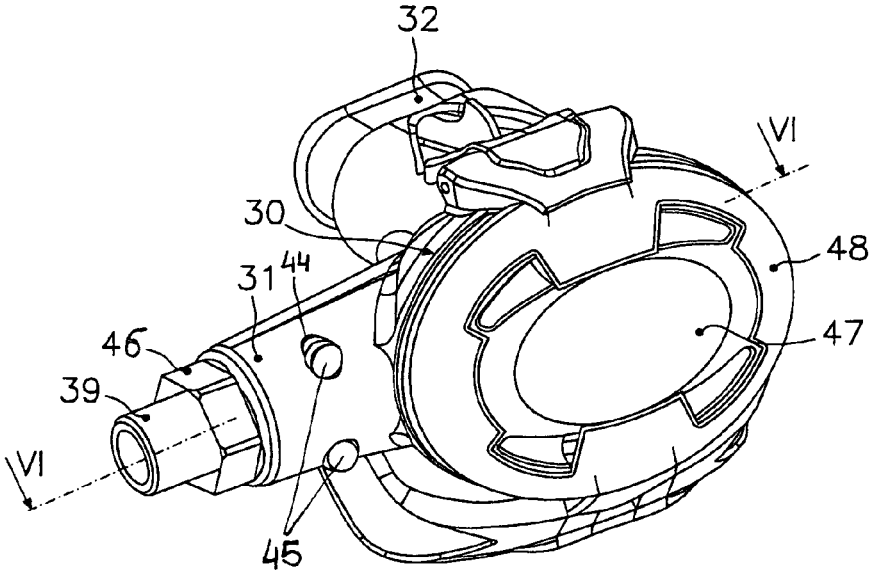
FIG. 5 is a perspective view of a second-stage regulator for scuba divers, according to one embodiment of the present invention.
Figure 8:
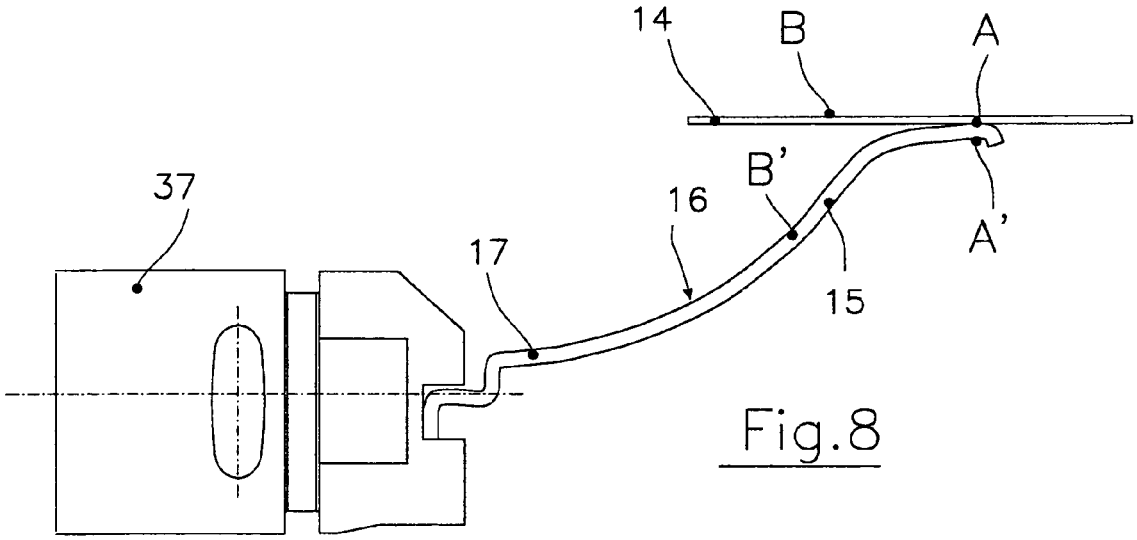
FIG. 8 is a partial view of an actuating lever of FIG. 5, controlled by movement of a diaphragm.
Figure 6:
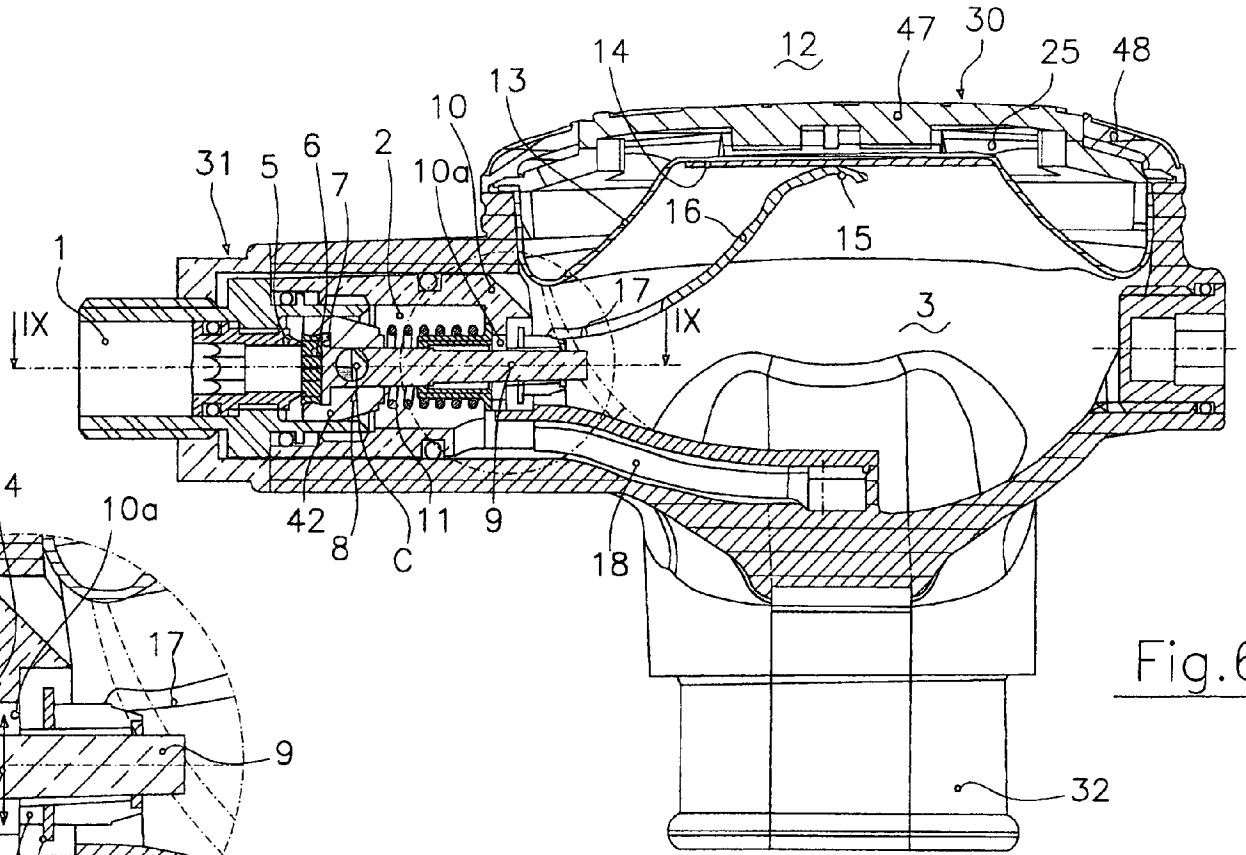
FIG. 6 is a sectional view taken along line VI-VI of FIG. 5.

According to one embodiment, illustrated generally in FIGS. 5 and 6, a regulator body 30 is provided, the body having an inlet conduit 31 and an outlet conduit 32. The inlet conduit connects to a first-stage regulator that delivers a breathable gas mixture at a relatively constant pressure and its interior forms an inlet chamber 1 and an intermediate chamber 2, separated by a valve seat 5 supporting seal 6 of head 7 of a poppet 8. Tail 9 of the poppet passes relatively loosely through a hole 10*a* in a baffle 10, which separates intermediate chamber 2 from an outlet chamber 3 communicating, through outlet conduit 32, with a mouthpiece applied thereto (not shown). Baffle 10 provides support for a spring 11 that compresses the head of the poppet 8 against the valve seat 5.

The regulator body also has a relatively large opening 25 closed by a deformable diaphragm 13 that separates outlet chamber 3 from outside or external environment 12. A lever 16 is also provided, the lever having an outer end 15 and an inner end 17. The outer end abuts a relatively thin rigid plate 14 on an inner surface of the diaphragm, and the inner end is hingedly connected to the baffle and attached to the tail of the poppet, the tail projecting from the baffle and into the outlet chamber. The mixture flows into the outlet chamber through a passage 18, e.g., being relatively wide. The inner end of the lever is shaped generally like a fork, as illustrated, for instance, in FIG. 4.

Figure 7:
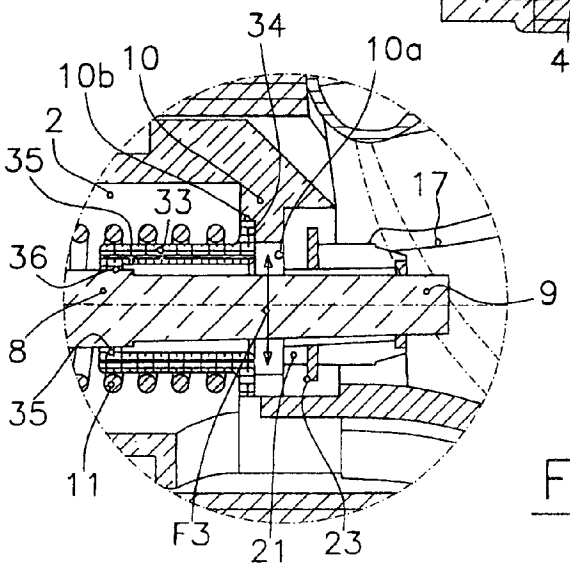
FIG. 7 is an enlarged view of the detail section set forth in FIG. 6.
Figure 9:
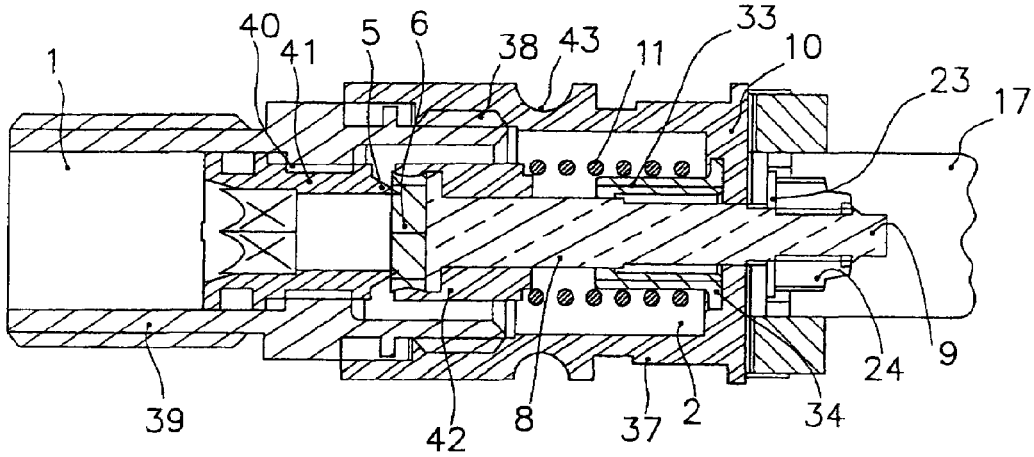
FIG. 9 is a sectional view taken along line IX-IX of FIG. 6.

As shown in FIGS. 7 and 9, an annular opening between hole 10*a* in baffle 10 and the tail of the poppet is closed by a flexible sleeve 33. The sleeve, for example, has a first, outer flange 34 facing the baffle, against which the sleeve is biased by spring 11 to form a seal inside a groove 10*b*. At another end, sleeve 33 is provided with a second, inner flange 35 engaged with a circumferential groove 36 on a surface of poppet 8 so as to form an airtight seal. The mixture may, therefore., pass only from intermediate chamber 2 to outlet chamber 3 through wide passage 18. This prevents "blow-by" of gaseous mixture, and associated cooling and freezing of the humidity in the fraction of the mixture that escapes, which would otherwise remain, at least partly in the form of tiny ice crystals in the annular opening. Such ice crystals may create frictional forces that act against the poppet tail and must be overcome by a portion of the vacuum created upon the user's inhalation.

As best seen in FIG. 9, the baffle, which separates the intermediate and outlet chambers from one another, includes an end of a first bushing 37. At an end of the bushing opposite the baffle, the bushing has internal threading 38 for engagement with external threading of a second bushing 39. The second bushing has internal threading 40 in proximity to its medial region for threaded engagement with a third bushing 41. The end of the third bushing facing head 7 of poppet 8, for instance, has an annular rib forming the valve seat for engagement with seal 6. In this manner, the third bushing forms the inlet chamber inside the second bushing; the intermediate chamber being formed between the third bushing and the baffle of the first bushing.

Turning now to FIGS. 6 and 9, the head of the poppet has a ferrule 42 of rectangular cross section. The ferrule has a section in the longitudinal plane, shown in FIG. 6, with at least a partially-circular profile abutting the inside wall of the intermediate chamber, the inside wall also having a substantially rectangular cross section, such that the poppet may oscillate about a transverse axis C. To enable this poppet movement, the width of the ferrule, along the axis of oscillation, is narrower than the width of the intermediate chamber. Such oscillation enables washer 23 (which is suitably mounted for sliding along the tail of the poppet) to move transversely in a direction indicated by arrows F3 (See FIG. 7) together with third flange 21 on the inner end of the lever. As a result, there is no sliding movement and, hence, friction between the washer and the arms of the third flange. By so eliminating the second cause of friction in second-stage regulators, the vacuum that the user must generate when he or she inhales is reduced further.

According to one aspect of the present invention, a method is provided for assembling a group of operative members for a second-stage regulator (See FIGS. 6, 7 and 9). First, flexible sleeve 33 is placed at the end of first bushing 37 with spring 11 resting on its outer flange 34. The ferrule 42 is then mounted on poppet 8, and tail 9 of the poppet is inserted through the spring, the sleeve and hole 10*a* in baffle 10 so as to form the end of the first bushing. Next, washer 23 is inserted on the threaded end of the tail of the poppet and nut 24 is screwed into place. Last, Z-shaped inner end 17 of lever 16 is inserted between the washer and the surface of the baffle on the side facing outlet chamber 3.

By adjusting the nut, the tightness of second bushing 39, in first bushing 37, and the tightness of third bushing 41 in the second bushing, the user may one hand it is possible to calibrate the force with which seal 6 of the poppet is applied to valve seat 5. Varying the degree of tightness of nut 24 also enables the user to calibrate the exact position of outer end 15 of lever 16.

The assembly may be readily adjusted prior to installation in regulator body 30 using a suitable tool through inlet conduit 31 on the regulator body. As shown in FIGS. 5 and 9, opposing grooves 43 are formed in the outer surface of first bushing 37, perpendicularly to the longitudinal axis of symmetry. In addition, holes 44 are formed in the inlet conduit at the same distance transversely from grooves 43 for receiving pins 45 when the grooves and holes are in alignment with one another. In this manner, the relative longitudinal position of the assembly vis-à-vis the inlet conduit is precisely defined. Finally, the assembly is secured in place by a nut 46 engaging the external threading on second bushing 39 until it abuts the end of the inlet conduit.

As for the third source of friction in second-stage regulators, namely, friction due to sliding motion of the rounded outer end of the lever against the plate underneath the inner surface of the diaphragm such sliding motion—and associated sliding friction—are converted, according to the present invention, to rolling motion and rolling friction, respectively. More specifically, outer end 15 of the lever has a profile such that it rolls along the underside of plate 14, remaining generally tangential to the latter, as the diaphragm and plate flex inwardly from a stowed or resting position to maximum expansion of the diaphragm. A profile or configuration of the end of the lever for accommodating operation in this fashion is set forth, for example, in FIG. 8.

Generally speaking, to achieve rolling rather than sliding motion between the lever and plate, it is considered necessary that segment AB on the plate, coinciding with a set of points of contact between the lever and plate from the resting position to maximum extension of the diaphragm, coincide with the length of arch A'B' on the lever, and that the tangent of B' remain horizontal.

As illustrated in FIG. 5, regulator body 30, for example, has an elongated shape suitable for housing diaphragm which, according to one aspect of the present invention, has an elliptical shape. This allows the transverse dimension of the regulator to be maintained within the overall dimensions of the surrounding apparatus, while increasing the surface area of the diaphragm. Such an arrangement is particularly beneficial for the user who now needs to expend much less effort and energy because the vacuum he or she must create upon inhalation decreases generally with increasing surface area of the diaphragm. Moreover, the diaphragm's elliptical shape enables the plate to remain parallel as it descends under the effect of the vacuum in the outlet chamber, action that is fundamental to proper operation of the lever and other moving parts of the regulator.

Figure 10:
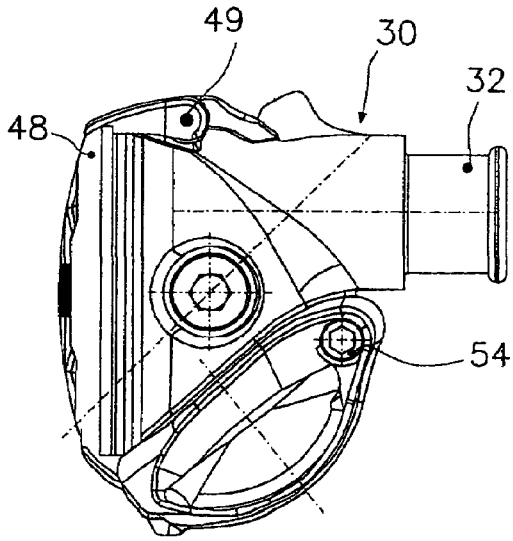
FIG. 10 is a side view of the regulator shown in FIG. 5.
Figure 11:
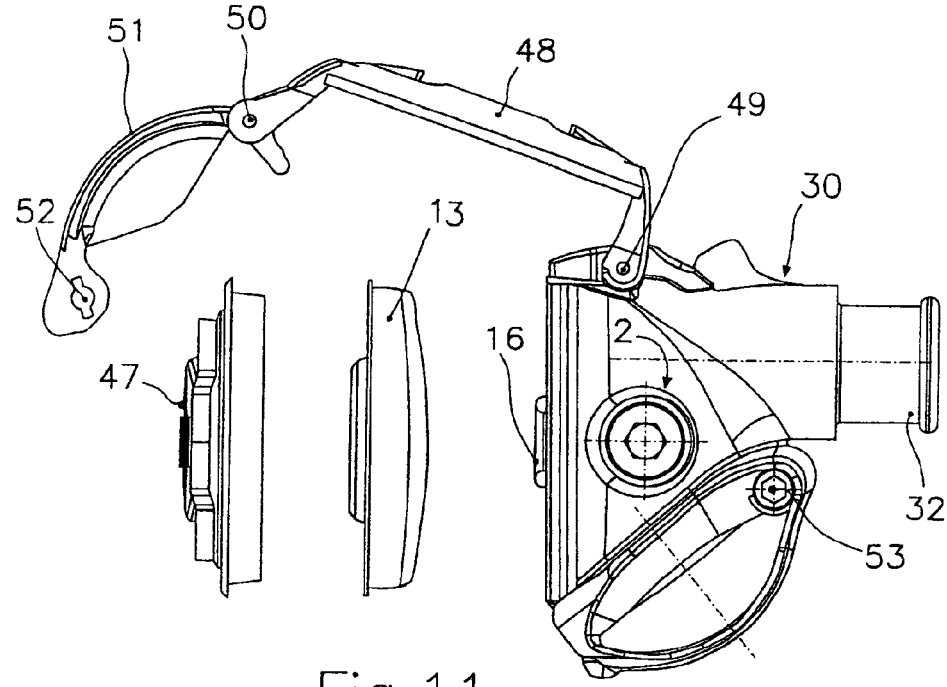
FIG. 11 is a side view of the regulator shown in FIG. 10 with the cover in a raised position, and the diaphragm and its protection grid shown in exploded view.

In traditional second-stage regulators, the diaphragm is attached to the edge of the corresponding opening by a covering frame threadably engaged with the regulator body after inserting an axially-movable control button, such that a slight amount of pressure on the button allows operation of the second-stage regulator to be checked and maintained at proper levels. With the present invention, on the other hand, as shown in FIGS. 10 and 11, the diaphragm and corresponding control button 47 are biased against an edge of a corresponding opening in the regulator body by a covering frame 48. One end of the frame is hingedly connected at 49 to regulator body 30, whereas another end is hingedly joined at 50 to a bracket 51 having a relatively long through hole 52. Desirably, the through hole is suitable for alignment with a corresponding hole 53 in the regulator body, when the frame is in a closed position as shown in FIG. 10. In this position, a pin 54 with an elongated head 55 is used to lock the assembly on the regulator body 30.

Figure 12:
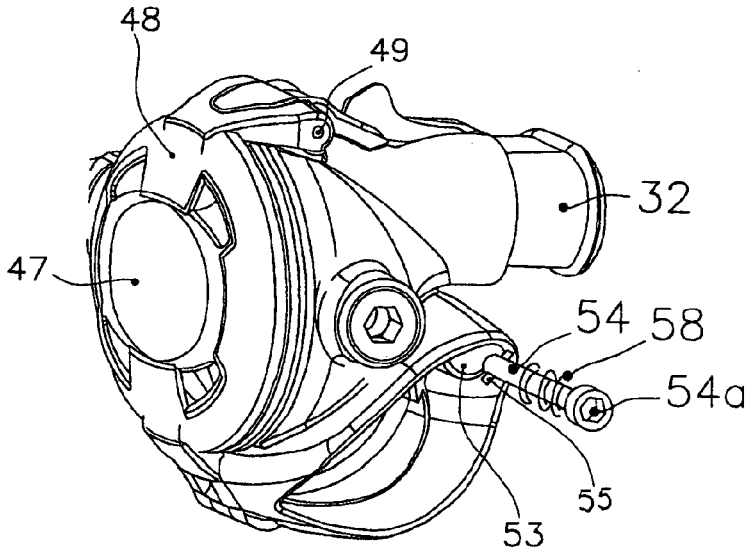
FIG. 12 is a perspective view of the regulator shown in FIG. 10 showing a member for locking the cover to the regulator body.
Figure 13:
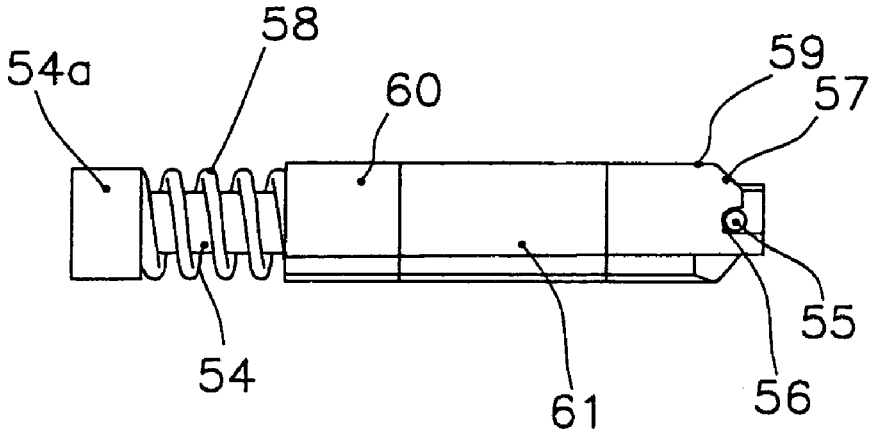
FIG. 13 is a side view of the locking member shown in FIG. 12 in a closed position.
Figure 14:
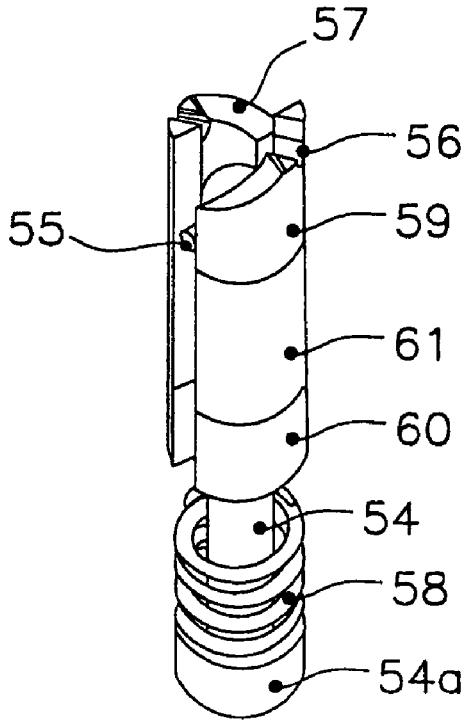
FIG. 14 is an isometric view of the locking member shown in FIG. 12.

According to a further arrangement, shown in FIGS. 12, 13 and 14, elongated head 55 on pin 54 is, for instance, a cross member engaging a seat 56 situated at an end of a cam profile 57. A spring 58, for example, maintains the cross member elastically in a closed position. FIGS. 13 and 14 illustrate members 59 and 60, according to one arrangement, where they are integral with the regulator body, while member 61 conforms with the end of bracket 51. Additionally, the pin has a head 54*a* with a prism-shaped cavity designed so that it may not be opened without the use of a special key. In this manner, unwanted or accidental opening of the regulator due to the release of bracket 51 and frame 48, and resulting detachment of the diaphragm, is prevented.

Various modifications and alterations to the present invention may be appreciated based on a review of this disclosure. These changes and additions are intended to be within the scope and spirit of the invention as defined by the following claims.

The invention claimed is:

1. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes the diaphragm inside the outlet chamber to flex inwardly and the lever to rotate, with consequential displacement of the poppet that, when lifted away from the valve seat, allows passage of the gaseous mixture from the inlet chamber, through the intermediate chamber and a passage between the intermediate chamber and the outlet chamber, to the outlet chamber, wherein inside the intermediate chamber, and coaxial to the poppet, a flexible sleeve is coupled by an airtight connection to the poppet and to the baffle about the opening in the baffle, the width of the poppet tail being substantially less than that of the opening so as to provide clearance for movement of the tail transversely to the opening of the baffle.

2. The regulator set forth in claim 1, wherein an elastic member is provided between the baffle and the head of the poppet for urging the head against the valve seat, and wherein the flexible sleeve has, at one end, a first flange sealingly engaged with a corresponding groove on an inner surface of the poppet and, at the other end, a second flange urged by the elastic member against the baffle around the opening.

3. The regulator set forth in claim 1, wherein the head of the poppet is set inside a ferrule of substantially rectangular cross section, the cross section of the ferrule in a median longitudinal plane of the second-stage regulator, such plane also including the lever, having at least an at least partially-circular profile abutting an inside wall of the intermediate chamber, enabling the poppet to oscillate in the longitudinal plane.

4. The regulator set forth in claim 3, wherein the intermediate chamber has a substantially rectangular cross section and the width of the ferrule measured along the axis of oscillation is generally less than the width of the intermediate chamber.

5. The regulator set forth in claim 1, wherein the end of the lever that is in contact with the diaphragm, or with a rigid plate attached to the diaphragm, has a generally arched shape with a profile such that the length of the arch between two adjacent points of contact measured along the lever is generally equal to the length of the segment between the same two adjacent points of contact measured along the diaphragm or the rigid plate.

6. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes the diaphragm inside the outlet chamber to flex inwardly and rotation of the lever, with a consequent displacement of the poppet that, when lifted away from the valve seat, allows passage of the gaseous mixture from the inlet chamber, through the intermediate chamber and a passage between the inlet chamber and the outlet chamber, to the outlet chamber, wherein the head of the poppet is inside a ferrule of substantially rectangular cross section, the cross section of the being ferrule in a median longitudinal plane of the second-stage regulator, such plane also including the lever, having an at least partially-circular profile abutting an inside wall of the intermediate chamber, enabling the poppet to oscillate in the longitudinal plane transversely to the opening of the baffle.

7. The regulator set forth in claim 6, wherein the intermediate chamber has a substantially rectangular cross section and the width of the ferrule, measured along the axis of oscillation, is generally less than that of the intermediate chamber.

8. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes an inward flexing of the diaphragm inside the outlet chamber and rotation of the lever, with a consequent displacement of the poppet that, when lifted away from the valve seat, allows passage of the gaseous mixture from the inlet chamber, through the intermediate chamber and a passage between the intermediate chamber and the outlet chamber, to the outlet chamber, wherein the end of the lever in contact with the diaphragm has a generally arched shape with a profile such that the length of the arch between two adjacent points of contact measured along the lever is generally equal to the length of the segment between the same two adjacent points of contact measured along the diaphragm or a rigid plate attached to the diaphragm, wherein the poppet oscillates transversely to the opening of the baffle.

9. The regulator set forth in claim 8, wherein the inlet conduit comprises a first bushing defining the intermediate chamber, an end of which forms the baffle, a second bushing engaged with the first bushing and defining the inlet chamber, and a third bushing engaged with the second bushing and defining the valve seat at one of its ends.

10. The regulator set forth in claim 9, wherein a member is provided for relative axial positioning of the first bushing in relation to the regulator body.

11. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes an inward flexing of the diaphragm inside the outlet chamber and rotation of the lever, with a consequent displacement of the poppet that, when lifted away from the valve seat, allows passage of the gaseous mixture from the inlet chamber, through the intermediate chamber and a passage between the intermediate chamber and the outlet chamber, to the outlet chamber wherein the end of the lever in contact with the diaphragm has a generally arched shape with a profile such that the length of the arch between two adjacent points of contact measured along the lever is generally equal to the length of the segment between the same two adjacent points of contact measured along the diaphragm or a rigid plate attached to the diaphragm, the inlet conduit comprising a first bushing defining the intermediate chamber, an end of which forms the baffle, a second bushing engaged with the first bushing and defining the inlet chamber, and a third bushing engaged with the second bushing and defining the valve seat at one of its ends, and a member being provided for relative axial positioning of the first bushing in relation to the regulator body, the axial positioning member comprising at least a pin for inserting in a hole formed in the regulator body suitable for fitting into a corresponding transverse groove in a side of the first bushing.

12. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes an inward flexing of the diaphragm inside the outlet chamber and rotation of the lever, with a consequent displacement of the poppet that, when lifted away from the valve seat, allows passage of the gaseous mixture from the inlet chamber, through the intermediate chamber and a passage between the intermediate chamber and the outlet chamber, to the outlet chamber wherein the end of the lever in contact with the diaphragm has a generally arched shape with a profile such that the length of the arch between two adjacent points of contact measured along the lever is generally equal to the length of the segment between the same two adjacent points of contact measured along the diaphragm or a rigid plate attached to the diaphragm, the diaphragm being blocked inside the opening by a covering frame articulated to the regulator body, fasteners being provided for securing the frame to the regulator body, wherein the poppet oscillates transversely to the opening of the baffle.

13. A second-stage regulator for scuba divers, which comprises a regulator body with an inlet conduit for connecting to a first-stage regulator that delivers a breathable gaseous mixture at a relatively constant pressure, an outlet conduit for connection to a user's mouthpiece, and an opening blocked by a deformable diaphragm, the inlet conduit forming an inlet chamber and an intermediate chamber separated by a valve seat, against which a head of a poppet movable within the intermediate chamber is elastically biased, a tail of the poppet projecting into an outlet chamber through an opening in a baffle that separates the intermediate chamber from the outlet chamber, and being connected to one end of a lever hinged to the baffle, the other end of the lever resting against the diaphragm so that a vacuum generated upon the user's inhalation causes an inward flexing of the diaphragm inside the outlet chamber and rotation of the lever, with a consequent displacement of the poppet that, when lifted away from the valve seat, allows passage of the gaseous mixture from the inlet chamber, through the intermediate chamber and a passage between the intermediate chamber and the outlet chamber, to the outlet chamber wherein the end of the lever in contact with the diaphragm has a generally arched shape with a profile such that the length of the arch between two adjacent points of contact measured along the lever is generally equal to the length of the segment between the same two adjacent points of contact measured along the diaphragm or a rigid plate attached to the diaphragm, the diaphragm being blocked inside the opening by a covering frame articulated to the regulator body, fasteners being provided for securing the frame to the regulator body, wherein a bracket affixable at its free end to the regulator body is hingedly connected to the frame.

14. The regulator set forth in claim 13, wherein a pin is provided for securing the bracket to the regulator body, the pin having a substantially T-shaped head passing through the free end of the bracket for snapping engagement with a seat in the regulator body after its rotation around its longitudinal axis, an elastic member coaxial to the pin being provided to prevent detachment of the substantially T-shaped head from the seat.

* * * * *